US005904316A

United States Patent [19]

Dunning et al.

[11] Patent Number: 5,904,316

[45] Date of Patent: May 18, 1999

[54] APPARATUS FOR HOLDING AND DISPENSING A CORELESS ROLL OF TOILET TISSUE

[75] Inventors: Charles E. Dunning, Neenah, Wis.; Rudolph W. Schutz, Walnut Creek, Calif.

[73] Assignee: Fort James Operating Company, Richmond, Va.

[21] Appl. No.: 08/380,824

[22] Filed: Jan. 30, 1995

[51] Int. Cl.[6] ..... B65H 16/02; B26F 3/02

[52] U.S. Cl. ..... 242/595; 225/42; 225/52

[58] Field of Search ..... 242/595, 594.1, 242/594.2; 225/39, 42, 43, 52, 84

[56] References Cited

U.S. PATENT DOCUMENTS

| | | | |
|---|---|---|---|
| 350,808 | 10/1886 | Cole | 225/42 |
| 495,892 | 4/1893 | Keep | 83/224 |
| 1,012,543 | 12/1911 | Hallett | 242/595 |
| 1,436,990 | 11/1922 | Lillibridge | 312/34.24 |
| 2,003,044 | 5/1935 | Galante | 225/42 |
| 2,322,456 | 6/1943 | Krueger | 242/595 |
| 2,334,757 | 11/1943 | Ensminger | 225/23 |
| 2,390,399 | 12/1945 | Tator et al. | 225/42 |
| 2,419,809 | 4/1947 | Avery | 221/70 |
| 2,472,712 | 6/1949 | Lifschitz | 312/34.8 |
| 2,606,724 | 8/1952 | Hertz | 242/598.1 |
| 2,626,761 | 1/1953 | Simpson et al. | 225/42 |
| 2,969,169 | 1/1961 | Botnick | 225/43 |
| 5,170,958 | 12/1992 | Brown | 312/34.8 X |

FOREIGN PATENT DOCUMENTS

| | | | |
|---|---|---|---|
| 833971 | 2/1970 | Canada . | |
| 2627905 | 1/1978 | Germany | 242/595 |
| 799084 | 11/1956 | United Kingdom . | |
| 2126988 | 7/1983 | United Kingdom . | |

*Primary Examiner*—John Q. Nguyen

*Attorney, Agent, or Firm*—Burns, Doane, Swecker & Mathis, L.L.P.

[57] ABSTRACT

Apparatus for holding and dispensing a coreless roll of toilet tissue and for retrofit to a wall-mounted dispenser normally employed to support and dispense a conventional roll of toilet tissue having a central core. The apparatus includes a receptacle having two spaced projections which are inserted in spaces of the wall-mounted dispenser which normally receive the ends of a support spindle for supporting a conventional roll of toilet tissue having a central core.

6 Claims, 3 Drawing Sheets

APPARATUS FOR HOLDING AND DISPENSING A CORELESS ROLL OF TOILET TISSUE

TECHNICAL FIELD

This invention relates to apparatus for holding and dispensing a coreless roll of toilet tissue. More particularly, the apparatus is for retrofit to a wall-mounted dispenser normally employed to support and dispense a conventional roll of toilet tissue having a central core.

BACKGROUND ART

Toilet tissue rolls are conventionally in the form of a strip of toilet tissue wrapped about a central hollow core formed of paperboard or other material. Wound toilet tissue forms a plurality of convolutions about the core.

Toilet tissue rolls incorporating cores are commonly mounted on spindles passing through the core interior, the spindles themselves having the ends thereof disposed in opposed spaces defined by the dispensing holder.

Coreless rolls of toilet tissue have been finding increasing acceptance in the market place. In coreless rolls of toilet tissue, the innermost convolution of the wound sheet of toilet tissue itself defines a central opening. This opening is quite small and constricted as compared to the size of the central core opening of more conventional toilet tissue rolls with cores. While spindles have been devised for use when supporting coreless rolls, at least one of the spindle ends is quite small as compared to the ends of the spindles utilized to rotatably support rolls of toilet tissue having cores. As a consequence, existing conventional wall-mounted holders designed for use with rolls with cores are not suitable for use with coreless toilet tissue rolls or spindles specifically adapted for use with coreless toilet tissue rolls.

The following patents and patent publications are believed to be representative of the current state of the prior art in this field: U.S. Pat. No. 350,808, issued Oct. 12, 1886, U.S. Pat. No. 495,892, issued Apr. 18, 1893, U.S. Pat. No. 1,012,543, issued Dec. 19, 1911, U.S. Pat. No. 1,436,990, issued Nov. 28, 1922, U.S. Pat. No. 2,322,456, issued Sep. 2, 1941, U.S. Pat. No. 2,334,757, issued Nov. 23, 1943, U.S. Pat. No. 2,390,399, issued Dec. 4, 1945, U.S. Pat. No. 2,419,809, issued Apr. 29, 1947, U.S. Pat. No. 2,472,712, issued Jun. 7, 1949, U.S. Pat. No. 2,606,724, issued Aug. 12, 1952, U.S. Pat. No. 2,626,761, issued Jan. 27, 1953, U.S. Pat. No. 5,170,958, issued Dec. 15, 1992, Canadian Patent No. 833,971, issued Feb. 10, 1970, U.K. Patent specification No. 799,084, published Jul. 30, 1958, and U.K. Patent Application No. 2,126,988A, published Apr. 4, 1984.

The patents and patent publications indicated above do not disclose apparatus for holding and dispensing a coreless roll of toilet tissue which is retrofitted to a wall-mounted dispenser normally employed to support and dispense a conventional roll of toilet tissue having a central core.

DISCLOSURE OF INVENTION

The present invention relates to an apparatus which inexpensively, efficiently, and effectively retrofits or adapts a wall-mounted dispenser normally employed to support and dispense a conventional roll of toilet tissue having a central core for use as a holder and dispenser for a coreless roll of toilet tissue.

The wall-mounted dispenser includes two spaced side supports and defines a void for accommodating a roll of toilet tissue located between the spaced side supports. Each side support defines a side support space for receiving the end of a support spindle for supporting a conventional roll of toilet tissue having a central core.

The apparatus of the present invention includes a receptacle having a receptacle interior for accommodating a coreless roll of toilet tissue. The receptacle includes a receptacle bottom and first and second receptacle sides.

The first and second receptacle sides have outer receptacle side surfaces spaced apart a distance less than the distance between the spaced side supports of a wall-mounted dispenser whereby the receptacle can be positioned in the void thereof with the outer receptacle sides located between the spaced side supports.

A first projection extends outwardly from the first receptacle side and has a distal end.

A second projection extends outwardly from the second receptacle side and has a distal end. The first and second projections are for positioning in the side support spaces of a wall-mounted dispenser to retain the apparatus on the wall-mounted dispenser and in the wall-mounted dispenser void.

At least one of the projections is movable relative to the receptacle bottom between a first position wherein the distance between the distal ends of the projections is greater than the distance between the side supports of the wall mounted dispenser and a second position wherein the distance between the distal ends is less than the distance between the side supports.

Other features, advantages, and objects of the present invention will become apparent with reference to the following description and accompanying drawings.

BEST MODE FOR CARRYING OUT THE INVENTION

Figure 1:
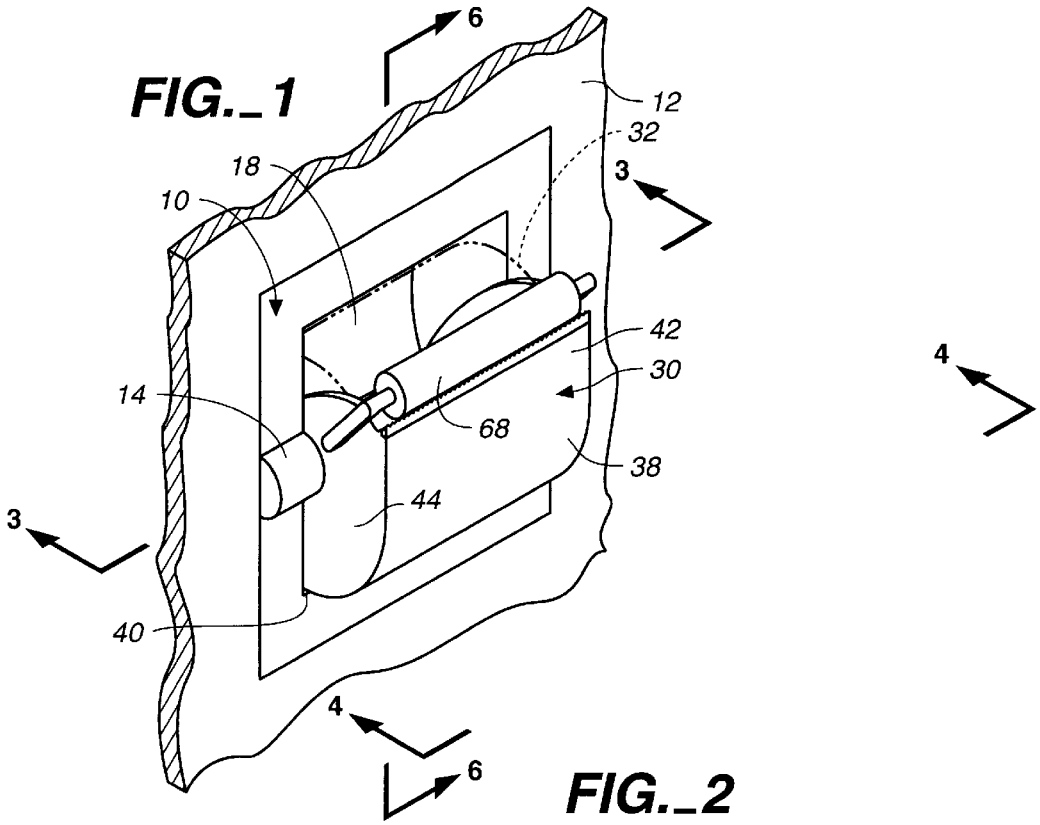
FIG. 1 is a frontal, perspective view showing a portion of a wall with the apparatus of the present invention supported by a wall-mounted dispenser normally employed to support and dispense a conventional roll of toilet tissue having a central core.

Referring to the drawings, reference numeral 10 designates a wall-mounted dispenser normally employed to support and dispense a conventional roll of toilet tissue having a central core (not shown). Dispenser 10 is positioned in a recess formed in a wall 12, only a portion of which is illustrated.

Wall-mounted dispenser 10 includes two spaced side supports 14, 16 and defines a void 18 open at the front and having a semicircular configuration. It is to be understood, however, that the specific wall-mounted dispenser 10 illustrated is to be considered representational only and that the principles of the present invention can be applied to wall-mounted dispensers of a wide variety of configurations and sizes.

Side supports 14, 16 define side support spaces 20 of circular cross-section for receiving an end of a support spindle (not shown) of conventional construction for supporting a conventional roll of toilet tissue having a central core. Such mechanisms are very well known in the prior art, form no part of the present invention, and need not be described or illustrated.

Apparatus constructed in accordance with the teachings of the present invention is designated by reference numeral 30. The apparatus is for holding and dispensing a coreless roll of toilet tissue 32 and for retrofit to wall-mounted dispenser 10. That is, the purpose of the present invention is to retrofit or adapt the wall-mounted dispenser for use with a coreless roll of toilet tissue.

Apparatus 30 includes a receptacle 38. Receptacle 38 includes a receptacle bottom 40, an integral receptacle front 42, and integral vertically oriented side walls 44, 46. Receptacle 38 may be formed of any suitable material such as molded plastic.

The receptacle bottom, front, and side walls form a receptacle interior 48 for accommodating a coreless roll of toilet tissue 32. The receptacle is of generally trough-like configuration and a coreless roll of toilet tissue will simply rest on the receptacle bottom within the interior with the coreless roll having the rotational axis thereof horizontally oriented. In the disclosed arrangement, the receptacle bottom is curved to generally conform to the outer shape of a full coreless roll.

A projection 50 in the form of a boss having a circular cross-sectional configuration is affixed to and extends outwardly from side wall 44. Similarly, a projection 52 of like construction is affixed to and extends outwardly from side wall 46. Each of the projections has a distal end 60.

Figure 2:
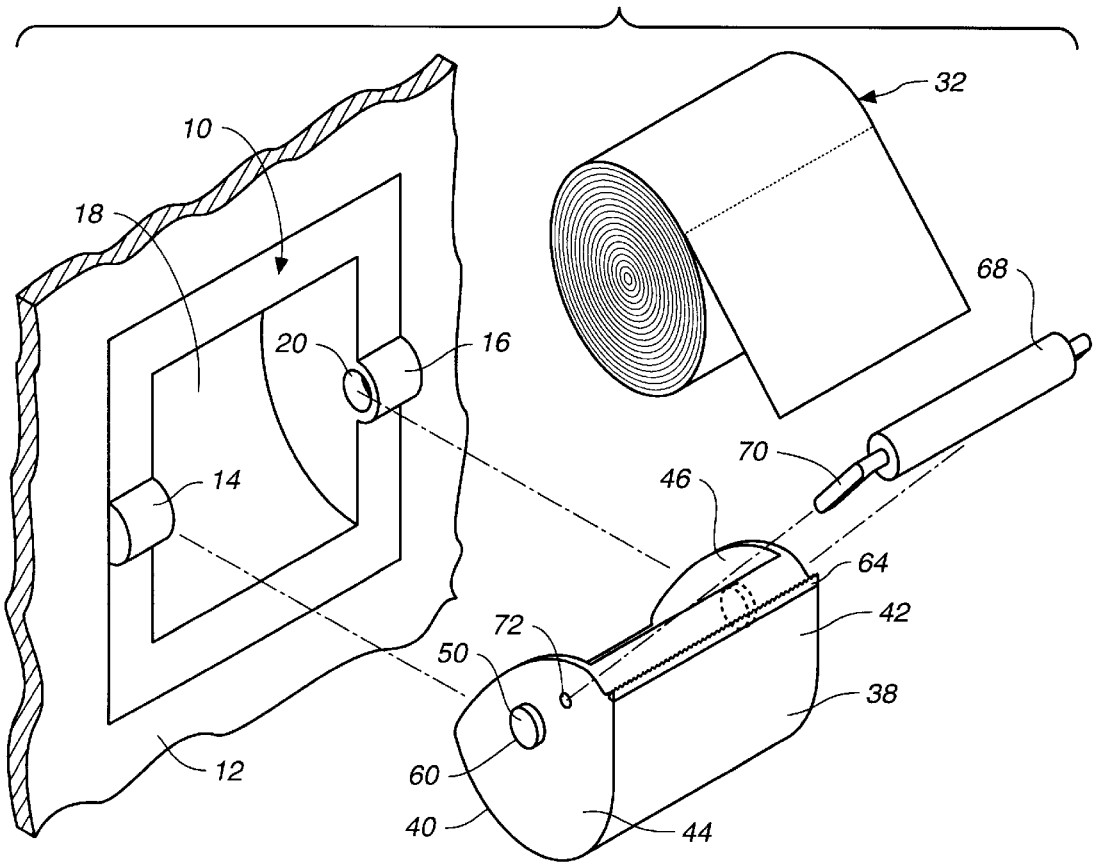
FIG. 2 is an exploded, perspective view of the wall-mounted support, components of the apparatus of the present invention, and a coreless roll of toilet tissue.
Figure 3:
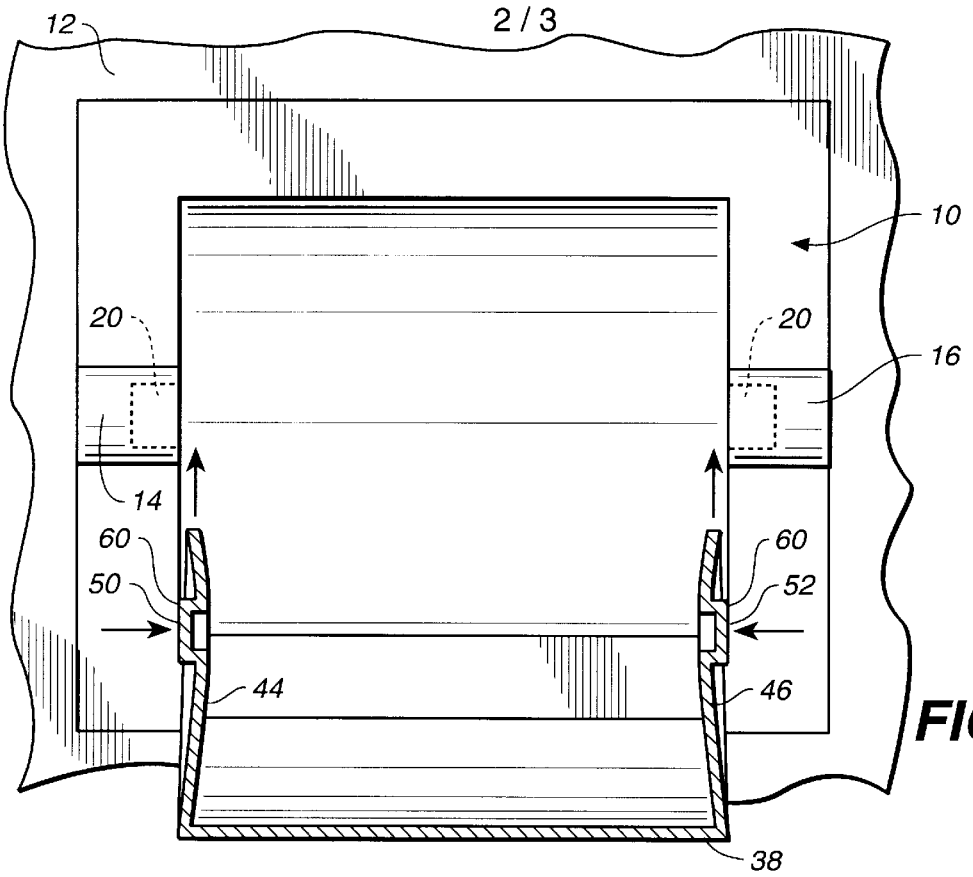
FIG. 3 is an enlarged, elevational view taken along the line 3—3 in FIG. 1, and illustrating apparatus of the present invention just prior to interconnection with the wall-mounted dispenser.

Side walls 44, 46 are normally planar, i.e. extend vertically over the full extent thereof. The outer surfaces of the side walls are spaced apart a distance less than the distance between the spaced side supports 14, 16 of wall-mounted dispenser 10 whereby the receptacle 46 can be positioned in wall-mounted dispenser void 18. When the side walls 46, 48 are in their normal planar condition (shown in FIGS. 1, 2, and 4, for example) the projections 50, 52 will engage the fronts of side supports 14, 16 and thus not permit complete installation of the receptacle 38 on the wall-mounted dispenser 10. However, the side walls 46, 48 are somewhat flexible and resilient, capable of being deflected inwardly, as shown in FIG. 3, upon application of outside forces thereto by the installer. These forces are represented by the horizontal arrows in FIG. 3.

Figure 4:
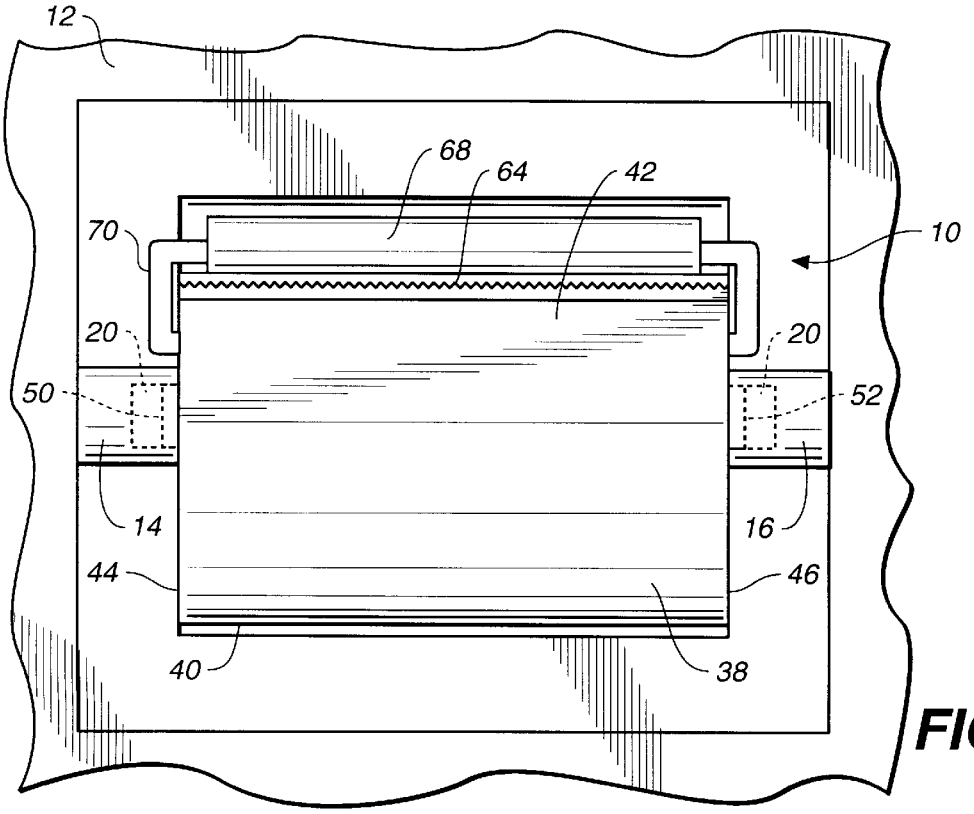
FIG. 4 is an enlarged, frontal view taken along the line 4—4 of FIG. 1, and illustrating the apparatus in place on and interconnected with the wall-mounted dispenser.

Such deflection will allow the projections 50, 52 to move toward each other and relative to the receptacle bottom so that the distance between the projection distal ends 60 will be less than the distance between side supports 16 where the side supports define spaces 20 and thus allow full positioning of the receptacle in the void. Release of the inwardly directed forces or pressure on the side walls 46, 48 will allow the resilient, flexible side walls to reattain their normal planar condition and seat the projections 50, 52 in side support spaces 20. This is shown in FIG. 4, for example. Removal of the receptacle from wall-mounted dispenser 10 is accomplished just as readily by again deflecting the receptacle side walls 46, 48 inwardly.

Figure 6:
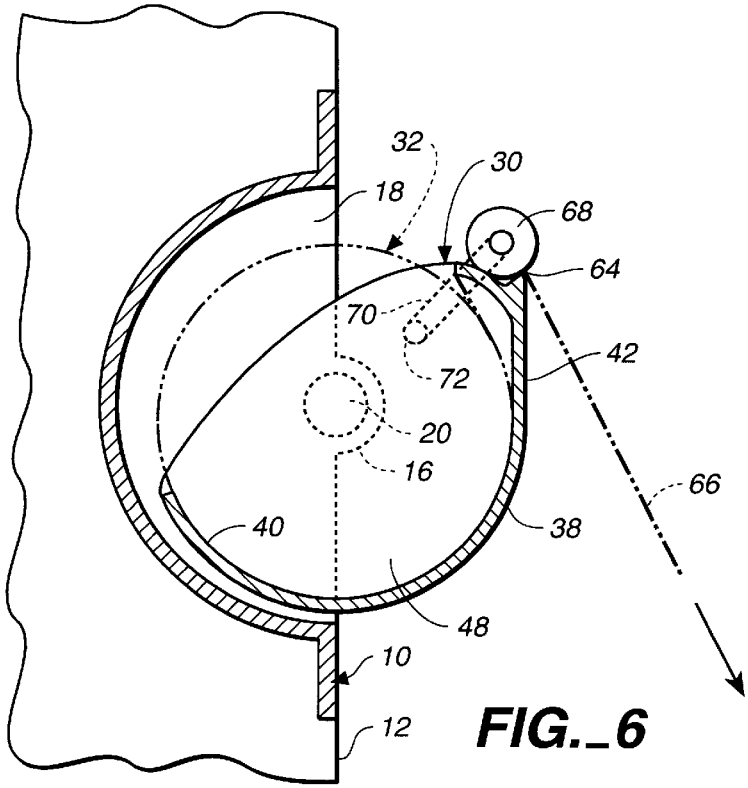
FIG. 6 is an enlarged, cross-sectional view taken along the line 6—6 in FIG. 1 and illustrating the coreless roll of toilet tissue in place on the apparatus and the apparatus in operative condition.

Actual dispensing of toilet tissue from a coreless roll of toilet tissue 32 is also quite simple. Receptacle front 42 has an upper end at which a toilet tissue cutting edge 64 is formed or located. In the arrangement illustrated, the cutting edge is comprised of a plurality of cutting teeth disposed along the length of the receptacle. These teeth are employed to sever a lead end of the toilet tissue from the remainder of the coreless roll. In FIG. 6, the toilet tissue lead end is designated by reference numeral 66. The lead end is drawn over the upper edge of the receptacle front and pulled downwardly by the user as indicated by the arrow in FIG. 6 to sever the desired amount of toilet tissue from the roll 32.

To facilitate the severing operation, a rider roll 68 is deployed on the receptacle by a mounting bracket 70 of generally U-shaped configuration. The free ends of the mounting bracket are inserted in and rotatably disposed relative to apertures 72 in the receptacle side walls 44, 46. When in its operative position, rider roll 68 extends along and is closely adjacent to cutting edge 64, the toilet tissue passing between the rider roll and the cutting edge and engaged thereby.

Figure 5:
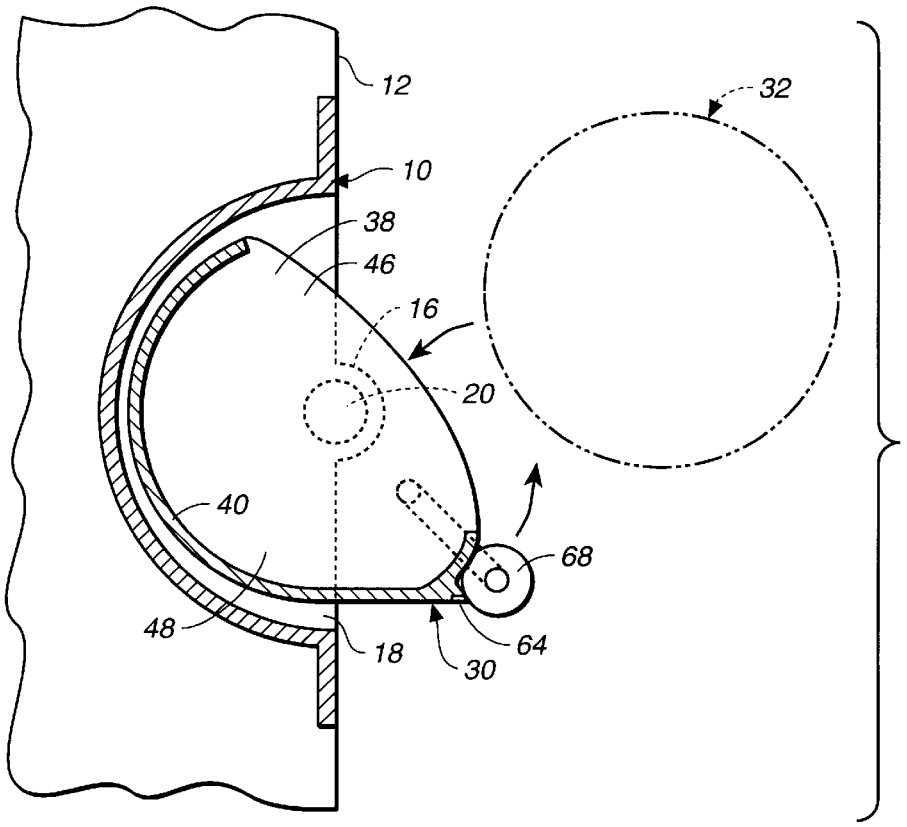
FIG. 5 is a cross-sectional, side view illustrating diagrammatically a roll of coreless toilet tissue being inserted into the interior of the apparatus mounted on the wall-mounted dispenser.

In the embodiment illustrated, the projections 50, 52 are rotatably journaled in their respective side supports 14, 16 so that the receptacle may be rotated relative to the wall-mounted dispenser 10 between the positions shown in FIGS. 5 and 6. When the receptacle is in its FIG. 5 position, the open-topped trough defined thereby can readily accept the coreless roll of toilet tissue without requiring removal of the apparatus from the wall-mounted dispenser. FIG. 6 shows the apparatus rotated back to its normal operating position.

It will be appreciated that other embodiments of the invention are possible. For example, one or more of the side walls could be of rigid construction. One or more of the projections could be spring biased outwardly to ensure retention, when extended, in the spaces of the side supports. The distal ends would be depressed for insertion in or removal from the support spaces. Another possible alternative would be to provide a threaded connection between at least one of the projections and its associated side wall whereby the projection could be "screwed" into its associated side wall to allow insertion of the receptacle into the dispenser. Once inserted, the projection would be "unscrewed" to extend into the spaces of the supports. The advantage of these more rigid constructions would be to reduce pilferage of the receptacles and toilet-tissue rolls from public rest rooms.

We claim:

1. Apparatus comprising, in combination:

a wall mounted dispenser normally employed to support and dispense a conventional roll of toilet tissue having a central core, said wall mounted dispenser including two spaced side supports and defining a void for accommodating a roll of toilet tissue located between said spaced side supports, each side support defining a side support space for receiving an end of a support spindle for supporting a conventional roll of toilet tissue having a central core;

a receptacle having a receptacle interior in the form of an open-topped trough for accommodating a coreless roll of toilet tissue, said receptacle including a receptacle bottom, a front connected to said receptacle bottom and extending upwardly therefrom, and first and second receptacle side walls defining said open-topped trough, said first and second receptacle side walls having outer receptacle side surfaces spaced apart a distance less than the distance between the spaced side supports of said wall mounted dispenser and said receptacle positioned in the void thereof with said receptacle first and second side walls located between the spaced side supports;

a first projection extending outwardly from outer receptacle side surface of said first receptacle side wall and having a distal end; and a second projection extending outwardly from the outer receptacle side surface of said second receptacle side wall and having a distal end, said first and second projections positioned in the side support spaces of said wall mounted dispenser to retain the apparatus on the wall mounted dispenser and in the wall mounted dispenser void, at least one of said projections being movable relative to said receptacle bottom between a first position wherein the distance between the distal ends of the projections is greater than the distance between the side supports of said wall mounted dispenser and a second position wherein the distance between the distal ends is less than the distance between the side supports, said receptacle being rotatable connected to said wall mounted dispenser by said first and second projections and movable between a first position wherein said wall mounted dispenser and said receptacle cooperate to maintain said open-topped trough substantially unexposed and a second position wherein said wall mounted dispenser and said receptacle cooperate to substantially expose said open-topped trough to allow insertion of a coreless roll of toilet tissue into said open-topped trough.

2. The apparatus according to claim 1 wherein each said projection comprises a boss having a circular cross section.

3. The apparatus according to claim 1 wherein at least one of said side walls is of flexible, resilient construction and deformable upon application of force thereto to move toward the other of said side walls and move the projection extending outwardly therefrom toward the other of said side walls.

4. The apparatus according to claim 3 wherein both of said side walls are of flexible, resilient construction and deformable upon application of force thereto.

5. The apparatus according to claim 1 wherein said receptacle front has an upper end having a toilet tissue cutting edge.

6. The apparatus according to claim 5 additionally comprising a rider roll mounted on said receptacle adjacent to said cutting edge for engaging toilet tissue unwound from a coreless roll of toilet tissue in said receptacle interior and passing between said rider roll and said cutting edge.

* * * * *